US006991750B2

(12) United States Patent
Majumdar et al.

(10) Patent No.: US 6,991,750 B2
(45) Date of Patent: Jan. 31, 2006

(54) COMPOSITION FOR ANTISTAT LAYER

(75) Inventors: Debasis Majumdar, Rochester, NY (US); Richard A. Castle, Webster, NY (US); Janglin Chen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/911,193

(22) Filed: Aug. 4, 2004

(65) Prior Publication Data

US 2005/0006629 A1 Jan. 13, 2005

Related U.S. Application Data

(62) Division of application No. 10/036,131, filed on Dec. 26, 2001, now Pat. No. 6,811,724.

(51) Int. Cl.
*H01B 1/00* (2006.01)
*H01B 1/20* (2006.01)

(52) U.S. Cl. ..... 252/500

(58) Field of Classification Search ..... 252/511, 252/512, 518.1, 500
See application file for complete search history.

(56) References Cited

U.S. PATENT DOCUMENTS

| | | | |
|---|---|---|---|
| 3,525,621 | A | 8/1970 | Miller |
| 4,266,016 | A | 5/1981 | Date et al. |
| 4,547,445 | A | 10/1985 | Asahina et al. |
| 4,981,729 | A | 1/1991 | Zaleski |
| 5,244,728 | A | 9/1993 | Bowman et al. |
| 5,378,574 | A | 1/1995 | Winnik et al. |
| 5,466,536 | A | 11/1995 | Berner et al. |
| 5,683,862 | A | 11/1997 | Majumdar et al. |
| 5,719,016 | A | 2/1998 | Christian et al. |
| 5,804,615 | A | 9/1998 | Schreiber et al. |
| 5,853,965 | A | 12/1998 | Haydock et al. |
| 5,853,967 | A | 12/1998 | Dickerson |
| 5,866,282 | A | 2/1999 | Bourdelais et al. |
| 5,874,205 | A | 2/1999 | Bourdelais et al. |
| 6,001,207 | A | 12/1999 | Enlow et al. |
| 6,077,656 | A | 6/2000 | Majumdar et al. |
| 6,148,503 | A | 11/2000 | Delnick et al. |
| 6,171,769 | B1 | 1/2001 | Majumdar et al. |
| 6,232,056 | B1 | 5/2001 | Aylward et al. |

FOREIGN PATENT DOCUMENTS

| | | | |
|---|---|---|---|
| DE | 41 25 758 | | 2/1993 |
| JP | 2-194071 | * | 7/1990 |
| WO | WO 90/12656 | * | 11/1990 |
| WO | WO 93/24584 | | 12/1993 |

* cited by examiner

*Primary Examiner*—Mark Kopec
(74) *Attorney, Agent, or Firm*—J. Lanny Tucker

(57) ABSTRACT

A composition for an antistat layer comprising: a chlorinated polyolefin; a conductive agent; and a solvent.

22 Claims, No Drawings

COMPOSITION FOR ANTISTAT LAYER

CROSS REFERENCE TO RELATED APPLICATIONS

This is a Divisional of application Ser. No. 10/036,131 filed Dec. 26, 2001, now allowed as U.S. Pat. No. 6,811,724.

This application relates to commonly assigned copending application Ser. No. 10/036,127, entitled ELEMENT WITH ANTISTAT LAYER, filed simultaneously herewith. The copending application is incorporated by reference herein for all that it contains.

FIELD OF THE INVENTION

The present invention relates to compositions for antistatic layers on imaging elements, preferably photographic paper, optionally with print or backmark retaining qualities and spliceability. Particularly, this invention relates to coating compositions suitable for the preparation of polypropylene coated photographic paper supports having an image forming layer and a layer capable of (i) providing antistatic characteristics, (ii) receiving and retaining various types of marking including, printing ink and the like, and (iii) being joined through beat splicing in typical photofinishing equipment.

BACKGROUND OF THE INVENTION

The problem of controlling static charge is well known in the field of photography. The accumulation of charge on film or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category.

However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers that contain conjugated polymers, semiconductive metal halide salts, semiconductive metal oxide particles, etc., have been described previously. However, these antistatic layers typically contain a high volume percentage of electronically conducting materials, which are often expensive and impart unfavorable physical characteristics, such as color, increased brittleness and poor adhesion, to the antistatic layer.

Besides antistatic properties, an auxiliary layer in a photographic element maybe required to fulfill additional criteria depending on the application. For example for resin-coated photographic paper, the antistatic layer if present as an external backing layer should be able to receive prints (e.g., bar codes or other indicia containing useful information) typically administered by dot matrix printers and to retain these prints or markings as the paper undergoes processing. Most colloidal silica based antistatic backings without a polymeric binder provide poor post-processing backmark retention qualities for photographic paper.

Yet another important criterion for photographic paper is its spliceability. Heat splicing of photographic paper rolls is often carried out during printing operations and is expected to provide enough mechanical strength to resist peeling as the web goes at high speed through automatic photographic processors following complicated paths including many turns around transport and guide rollers which puts a great deal of stress on the paper. Heat splicing is typically carried out between the silver halide side of the paper and the antistatic backside of the paper. Poor splice strength can cause a number of problems including jamming of automatic processing equipment resulting in machine shut down. Antistatic backings with poor adhesion to the paper base and/or poor cohesive strength are likely to provide inadequate splice strength.

In general, poor adhesion of the antistatic coating onto the resin-coated paper base may be responsible for a number of problems during manufacturing, sensitizing and photofinishing. Poor adhesion or cohesion of the antistatic backing can lead to unacceptable dusting and track-off. The dust particles require periodic cleaning, which can hamper smooth, continuous running of any equipment, thereby affecting productivity. The dust particles can also cause physical defects during coating and sensitizing, generating unacceptable product quality and waste. A discontinuous antistatic layer, resulting from dusting, flaking, or other causes, may exhibit poor lateral conductivity, and may not provide necessary static protection. It can also allow leaching of calcium stearate from the paper support into the processing tanks causing build-up of stearate sludge. Flakes of the antistatic backing in the processing solution can form soft tar-like species which, even in extremely small amounts, can re-deposit as smudges on drier rollers eventually transferring to image areas of the photographic paper, creating unacceptable defects.

Although the prior art is replete with patents disclosing various antistatic backings for photographic paper (for example, U.S. Pat. Nos. 3,671,248; 4,547,445; 5,045,394; 5,156,707; 5,221,555; 5,232,824; 5,244,728; 5,318,886; 5,360,707; 5,405,907 and 5,466,536), not all of the aforesaid issues are fully addressed by these inventions. Also, some of the inventions of the prior art may alleviate one or more problems but may aggravate some others. For example, U.S. Pat. No. 3,525,621 teaches that antistatic properties can be given to an aqueous coating composition by practically any silica sol, but preferably a silica of large surface area of the order of 200–235 $m^2/g$ in combination with an alkylaryl polyether sulfonate. However, the high solubility of the alkylaryl polyether sulfonate in aqueous medium causes leaching during processing resulting in poor backmark retention of such antistatic layers. Similarly, U.S. Pat. No. 5,244,728 teaches a binder polymer consisting of an addition product of alkyl methacrylate, alkali metal salt and vinyl benzene which, when incorporated in an antistatic layer for photographic paper, substantially improves backmark retention characteristics but compromises spliceability and track-off characteristics, as demonstrated in U.S. Pat. No. 5,683,862. U.S. Pat. No. 5,466,536 teaches the use of a mixture of polymers and copolymers with specific acrylic acid content for good printabilty. However, the high acid number of these polymers make the antistatic layer (or debris thereof) vulnerable for softening in high pH developer solution, and can cause formation of soft tar-like species discussed herein above.

Moreover, backings developed for one type of polyolefin-coated paper may fail on a different type of polyolefin-coated paper. Therefore, although claims are generally made for both polyethylene and polypropylene coated photographic paper, a vast majority of patents in the art provide examples involving polyethylene coated photographic paper only, and the successful application of these teachings on polypropylene coated photographic paper is often, and even generally, not possible. In general, good adhesion of antistatic layers on a polypropylene surface is more difficult to achieve than on a polyethylene surface. For example, in U.S. Pat. No. 4,547,445 a layer containing gelatin and an inorganic pigment is claimed to have ink-retaining characteristics with good adhesion to polyethylene-coated photographic paper. But, as discussed in U.S. Pat. No. 5,853,965, such a gelatin containing layer is expected to fail adhesion on a biaxially oriented polypropylene-coated photographic paper. In fact, adhesion of auxiliary layers to polypropylene surfaces has become a key issue for reflective print media, as more and more products comprising such a surface are being disclosed in the patent literature and introduced to the market (vide, for example, U.S. Pat. Nos. 5,853,965; 5,866,282; and 5,874,205). Antistatic layers containing a styrene-maleic anhydride copolymer, colloidal silica and crosslinking compounds containing ethyleneimino groups and/or epoxy rings are disclosed in U.S. Pat. No. 4,266,016, allegedly for good antistatic characteristics and adhesion on both polyethylene and polypropylene surfaces. However, as demonstrated through comparative samples in U.S. Pat. No. 6,171,769, such antistatic layers provide neither the backmark retention characteristics nor the spliceability currently desired of photographic paper. U.S. Pat. No. 6,171,769, by itself, teaches of binder polymers with excellent adhesion to polypropylene surfaces. However, these binder polymers are not known to have any appreciable electrical conductivity, and, thus do not participate in antistatic function by themselves. Typically, for a given dry coverage of the antistatic layer, the higher the amount of binder polymer the better is the adhesion but poorer is the electrical conductivity of the layer A vast majority of antistatic formulations designed for use in photographic reflective media are aqueous based coating compositions, utilizing salts for ionic conductivity, inorganic particles such as colloidal silica as fillers and latex polymers as binders. Although the salt is needed for electrical conductivity, its presence can adversely affect the dispersion of the latex and/or the colloidal filler, through charge screening. Such an adverse effect unacceptably increases the viscosity of the coating composition and/or its shelf life, rendering it impractical for robust manufacturing. A careful balance needs to be struck in the content of the various ingredients to maintain appropriate viscosity and yet achieve the physical properties, such as conductivity and adhesion to the substrate, required of the resultant antistatic layer. In this context, identification of a binder polymer, which adds to the electrical conductivity (and, therefore, requires less salt) as well as provides good adhesion to the support appears highly desirable.

Thus, it is clear that the known art does not fully meet the high demands and the diverse needs of the industry. Further innovation is needed. The present invention provides a composition suitable for use as an antistatic backing for photographic elements, particularly reflective print media, comprising at least one polyolefin layer, wherein the antistatic layer provides superior electrical conductivity, backmark retention, spliceability and dusting characteristics through improved adhesion to the support, formed out of robust coating compositions with controlled viscosity, fulfilling the stringent requirements of the industry.

SUMMARY OF THE INVENTION

It is an object of the present invention to provide a composition suitable for use in an imaging element, particularly, one comprising a reflective support. The invention provides an improved antistatic layer.

It is another object of the present invention to provide a composition suitable for use in an imaging element with an antistatic layer with excellent adhesion to a polypropylene, particularly biaxially oriented polypropylene, surface.

It is another object of the invention to provide an antistatic layer with minimal dusting.

It is a further object of the invention to provide a composition suitable for use in an imaging element with an antistatic backing layer with improved backmark retaining characteristics.

It is an even further object of the invention to provide an antistatic backing layer, which is spliceable in typical high speed photofinishing equipment.

These and other objects of the invention are achieved by providing a composition suitable for use in an imaging element with an antistatic layer wherein such a layer comprises chlorinated polyolefin, which provides exceptionally good adhesion to polyolefin surface as well as electrical conductivity.

DETAILED DESCRIPTION OF THE INVENTION

While the invention herein finds particular use in the photofinishing industry to print barcodes or other indicia on the back of paper prints by using dot matrix printers for example, it is useful and suitable for applying print or ink markings to any surface wherein the original surface does not possess the desired characteristics. The application with regard to photofinishing has a particularly stringent requirement because in order to be useful the backing layer must survive photographic processing through the automatic processing devices having the harshest conditions.

In photofinishing applications, the coating compositions must satisfy the following requirements:

1. The ingredients must be compatible. This is a particularly stringent requirement when antistatic agents are employed in the coating composition so that the print retaining layer also possesses antistatic properties. The binder polymer in the coating composition in the form of a latex can be easily destabilized causing agglomeration of the latex particles to occur.
2. The coatings must be alkali resistant, up to a pH of 10 to survive the photographic processing solutions.
3. The coatings must be resistant to discoloration due to processing solutions and/or aging.
4. The coatings must be able to receive and retain ink or other marking materials through the photographic processing.
5. The coatings must not be photoactive and interfere with the light sensitive portions of the photographic paper.
6. The coatings must have resistivity less than 13 log Ω/□, preferably equal to or less than 12 log Ω/□, and more preferably less than 10 log Ω/□ at 50% RH.
7. The backside coating must be spliceable to the frontside in commercially available splicing devices and maintain sufficient peel strength.
8. The coatings must be resistant to track off during conveyance by various roller/nip transport machines during manufacturing of the photographic paper and also in the development processor.
9. The coatings must be block resistant in the rolled form. That is, in preparation of printing paper for use in photographic applications, the paper in processing is rolled upon itself It is necessary that the print retaining layer does not block together with the opposite surface of the paper support.
10. The coatings must have a stability of at least 6 to 12 months in order to be commercially acceptable.

The coatings and the coating compositions according to this invention satisfy these requirements by utilizing a chlorinated polyolefin, which provides superior electrical conductivity as well as adhesion to the polyolefinic substrate of suitable reflective imaging media.

The chlorinated polyolefin applicable for this invention can be organic solvent borne or aqueous. For environmental reasons aqueous compositions are more desirable.

As mentioned in U.S. Pat. No.5,777,022, water-borne chlorinated polyolefin compositions have been developed which are useful as primers for coating polypropylene-based substrates. Example of such water-borne chlorinated polyolefin compositions are found in U.S. Pat. Nos. 5,427,856 and 5,198,485. None of these references teach an antistatic composition with a conductive agent.

The chlorinated polyolefins useful in this invention can be broadly described as a chlorinated polyolefin having a molecular weight (weight average) in the range of 9000 to 150,000, a softening point in the range of 75 degree to 115 degree C., and an amount of chlorine in the range of 15 to 35 wt percent, based on the weight of the polyolefin. Chlorinated polyolefins useful in the invention may be unmodified or further modified, e.g., by grafting of an imide or with a monomer containing a carboxylic acid group or carboxylic acid anhydride group, e.g., maleic anhydride. If further modified with an imide, the imide may be present at any level but preferred to be between about 0.001 and about 10 wt % based on the weight of the polyolefin. If further modified with a monomer containing a carboxylic acid group or carboxylic acid anhydride group, the monomer may be present at any level but preferred to be between about 0.001 and about 10 wt % based on the weight of the polyolefin. Preferably, for bonding to a polypropylene-based substrate, the polyolefin, which is chlorinated or otherwise modified is a propylene homopolymer or a propylene copolymer in which at least about 60 wt % of the monomer content is propylene.

The chlorinated polyolefin resin is preferably dispersed as particles in water in a conventional manner using surfactants and/or amines as known in the art. It is most convenient to use a commercial chlorinated polyolefin, such as water-borne chlorinated polyolefin compositions sold by Eastman Chemicals under trade names Eastman CP310W, Eastman CP347W and Eastman CP349W.

The aforesaid chlorinated polyole fin can be present in the antistatic layer of the present invention with or without other polymeric binders. Such other polymeric binders can include one or more of a water soluble polymer, a hydrophilic colloid or a water insoluble polymer, latex or dispersion. Particular preference is given to polymers selected from the group of polymers and interpolymers prepared from ethylenically unsaturated monomers such as styrene, styrene derivatives, acrylic acid or methacrylic acid and their derivatives, olefins, (meth)acrylonitriles, itaconic acid and its derivatives, maleic acid and its derivatives, vinyl halides, vinylidene halides, and others. Also included are aqueous dispersions of condensation polymers such as polyurethanes and polyesters. Also useful are primary amine addition salt interpolymers, specifically, the interpolymers that contain a polymerized vinyl monomer having a primary amine addition salt component. The most preferred polymeric binders to be used in conjunction with the chlorinated polyolefin of the present invention are those disclosed in U.S. Pat. Nos. 6,171,769 and 6,077,656.

The weight % of the chlorinated polyolefin in the dried antistatic layer can vary according to specific need but is preferred to be at least 1% and more preferred to be at least 3% and most preferred to be at least 5% to achieve desirable properties.

In addition to the chlorinated polyolefin, the antistatic layer of the present invention can comprise other electrically conductive agent(s), which can include any of the electronic and ionic conductive agents known in the art.

As mentioned earlier, the conductivity of antistatic layers employing an electronic conductor depends on electronic mobility rather than ionic mobility and is independent of humidity. Electronic conductors such as conjugated conducting polymers, conducting carbon particles, crystalline semiconductor particles, amorphous semiconductive fibrils, and continuous conductive metal or semiconducting thin films can be used in this invention to afford humidity independent, process-surviving antistatic protection. Of the various types of electronic conductors, electronically conductive metal-containing particles, such as semiconducting metal oxides, and electronically conductive polymers, such as, substituted or unsubstituted polythiophenes, substituted or unsubstituted polypyrroles, and substituted or unsubstituted polyanilines are particularly effective for the present invention.

Electronically conductive particles, which may be used in the present invention include conductive crystalline inorganic oxides, conductive metal antimonates, and conductive inorganic non-oxides. Crystalline inorganic oxides may be chosen from zinc oxide, titania, tin oxide, alumina, indium oxide, silica, magnesia, barium oxide, molybdenum oxide, tungsten oxide, and vanadium oxide or composite oxides thereof, as described in, e.g., U.S. Pat. Nos. 4,275,103; 4,394,441; 4,416,963; 4,418,141; 4,431,764; 4,495,276;

4,571,361; 4,999,276 and 5,122,445. The conductive crystalline inorganic oxides may contain a "dopant" in the range from 0.01 to 30 mole percent, preferred dopants being aluminum or indium for zinc oxide; niobium or tantalum for titania; and antimony, niobium or halogens for tin oxide. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694 is specifically contemplated. Particularly useful electronically conductive particles which may be used in the antistatic layer include acicular doped metal oxides, acicular metal oxide particles, acicular metal oxides containing oxygen deficiencies, acicular doped tin oxide particles, acicular antimony-doped tin oxide particles, acicular niobium-doped titanium dioxide particles, and the like. The aforesaid acicular conductive particles preferably have a cross-sectional diameter less than or equal to 0.02 $\mu$m and an aspect ratio greater than or equal to 5:1. Some of these acicular conductive particles, useful for the present invention, are described in U.S. Pat Nos. 5,719,016; 5,731,119; 5,939,243 and references therein.

If used, the volume fraction of the acicular electronically conductive particles in the dried antistatic layer of the invention can vary from 1 to 70% and preferably from 5 to 50% for optimum physical properties. For non-acicular conductive metal oxides, the volume fraction can vary from 15 to 90%, and preferably from 20 to 80% for optimum properties.

The invention is also applicable where the conductive agent comprises a conductive "amorphous" gel such as vanadium oxide gel comprised of vanadium oxide ribbons or fibers. Such vanadium oxide gels may be prepared by any variety of methods, including but not specifically limited to melt quenching as described in U.S. Pat. No. 4,203,769, ion exchange as described in DE 4,125,758, or hydrolysis of a vanadium oxoalkoxide as claimed in WO 93/24584. The vanadium oxide gel is preferably doped with silver to enhance conductivity. Other methods of preparing vanadium oxide gels which are well known in the literature include reaction of vanadium or vanadium pentoxide with hydrogen peroxide and hydrolysis of $VO_2$ OAc or vanadium oxychloride.

Conductive metal antimonates suitable for use in accordance with the invention include those as disclosed in, U.S. Pat. Nos. 5,368,995 and 5,457,013, for example. Preferred conductive metal antimonates have a rutile or rutile-related crystallographic structures and may be represented as $M^{+2}Sb^{+5}{}_2O_6$(where $M^{+2}$=$Zn^{+2}$, $Ni^{+2}$, $Mg^{+2}$, $Fe^{+2}$, $Cu^{+2}$, $Mn^{+2}$, $Co^{+2}$) or $M^{+2}Sb^{+5}O)_4$(where $M^{+3}$=$In^{+3}$, $Al^{+3}$, $Sc^{+3}$, $Cr^{+3}$, $Fe^{+3}$). Several colloidal conductive metal antimonate dispersions are commercially available from Nissan Chemical Company in the form of aqueous or organic dispersions. Alternatively, U.S. Pat. Nos. 4,169,104 and 4,110,247 teach a method for preparing $M^{+2}Sb^{+5}{}_2O_6$ by treating an aqueous solution of potassium antimonate with an aqueous solution of an appropriate metal salt (e.g., chloride, nitrate, sulfate, etc.) to form a gelatinous precipitate of the corresponding insoluble hydrate which may be converted to a conductive metal antimonate by suitable treatment.

If used, the volume fraction of the conductive metal antimonates in the dried antistatic layer can vary from 15 to 90%. But it is preferred to be between 20 to 80% for optimum physical properties.

Conductive inorganic non-oxides suitable for use as conductive particles in the present invention include: titanium nitride, titanium boride, titanium carbide, niobium boride, tungsten carbide, lanthanum boride, zirconium boride, molybdenum boride, acicular metal nitrides, acicular metal carbides, acicular metal silicides, acicular metal borides, acicular tin-doped indium sesquioxide and the like, as described, e.g., in Japanese Kokai No. 4/55492, published Feb. 24, 1992. Conductive carbon particles, including carbon black and carbon fibrils or nanotubes with single walled or multiwalled morphology can also be used in this invention. Example of such suitable conductive carbon particles can be found in U.S. Pat. No. 5,576,162 and references therein.

Suitable electrically conductive polymers that are preferred for incorporation in the antistatic layer of the invention are specifically electronically conducting polymers, such as those illustrated in U.S. Pat. Nos. 6,025,119; 6,060,229; 6,077,655, 6,096,491; 6,124,083; 6,162,596; 6,187,522; and 6,190,846. These electronically conductive polymers include substituted or unsubstituted aniline-containing polymers (as disclosed in U.S. Pat. Nos. 5,716,550; 5,093,439 and 4,070,189), substituted or unsubstituted thiophene-containing polymers (as disclosed in U.S. Pat. Nos. 5,300,575; 5,312,681; 5,354,613; 5,370,981; 5,372,924; 5,391,472; 5,403,467; 5,443,944; 5,575,898, 4,987,042 and 4,731,408), substituted or unsubstituted pyrrole-containing polymers (as disclosed in U.S. Pat. Nos. 5,665,498 and 5,674,654), and poly(isothianaphthene) or derivatives thereof These conducting polymers may be soluble or dispersible in organic solvents or water or mixtures thereof. Preferred conducting polymers for the present invention include polypyrrole styrene sulfonate (referred to as polypyrrole/poly (styrene sulfonic acid) in U.S. Pat. No. 5,674,654); 3,4-dialkoxy substituted polypyrrole styrene sulfonate, and 3,4-dialkoxy substituted polythiophene styrene sulfonate. The most preferred substituted electrically conductive polymers include poly(3,4-ethylene dioxypyrrole styrene sulfonate) and poly(3,4-ethylene dioxythiophene styrene sulfonate).

If used, the weight % of the conductive polymer in the dried antistatic layer of the invention can vary from 1 to 99% but preferably varies from 2 to 30% for optimum physical properties.

Although, humidity dependent, ionic conductors are traditionally more cost-effective than electronic conductors and find widespread use in reflective imaging media such as paper. Any such ionic conductor can be incorporated in the antistatic layer of the invention. Among the ionic conductors, alkali metal salts particularly those of polyacids, such as, lithium, sodium or potassium salt of polyacrylic or polymethacrylic acid, maleic acid, itaconic acid, crotonic acid, polysulfonic acid or mixed polymers of these compounds, as well as cellulose derivatives are effective conductive agents. The alkali salts of polystyrene sulfonic acid, napthalene sulfonic acid or an alkali cellulose sulfate are preferred. The combination of polymerized alkylene oxides and alkali metal salts, described in U.S. Pat. Nos. 4,542,095 and 5,683,862 incorporated herein by reference, is also a preferred choice. Also, preferred are inorganic particles such as synthetic or natural smectite clay for their electrical conductivity. Of particular preference for application in the present invention are those ionic conductors, which are disclosed in U.S. Pat. Nos. 5,683,862; 5,869,227; 5,891,611; 5,981,126; 6,077,656; 6,120,979; 6,171,769; and references therein. The most preferred choice of the ionically conductive agent for application in the antistatic layer of the present invention is a combination of a polyethylene ether glycol and lithium nitrate.

The weight ratio of the alkylene oxide to alkali metal salt in the dried antistatic layer can be between 5:95 to 95:5, but preferably between 20:80 and 80:20, and more preferably between 40:60 and 60:40. The combined weight of the alkylene oxide and the alkali metal salt as the electrically conductive agent can be 1–50% of the weight of the dried antistatic layer but preferably between 2–20%, and more preferably between 5–15% of the weight of the dried antistatic layer. The alkali metal salt of the polyacid as the electrically conductive agent can be 1–50% of the weight of the dried antistatic layer but preferably between 2–30%.

The conductive particles that can be incorporated in the antistatic layer are not specifically limited in particle size or shape. The particle shape may range from roughly spherical or equiaxed particles to high aspect ratio particles such as fibers, whiskers, tubes, platelets or ribbons. Additionally, the conductive materials described above may be coated on a variety of other particles, also not particularly limited in shape or composition. For example the conductive inorganic material may be coated on non-conductive silica, alumina, titania and mica particles, whiskers or fibers.

The antistatic layer of the invention is preferred to comprise a colloidal sol, which may or may not be electrically conductive, to improve physical properties such as durability, roughness, coefficient of friction, as well as to reduce cost. The colloidal sol utilized in the present invention comprises finely divided inorganic particles in a liquid medium, preferably water. Most preferably the inorganic particles are metal oxide based. Such metal oxides include tin oxide, titania, antimony oxide, zirconia, ceria, yttria, zirconium silicate, silica, alumina, such as boehmite, aluminum modified silica, as well as other inorganic metal oxides of Group III and IV of the Periodic Table and mixtures thereof. The selection of the inorganic metal oxide sol is dependent on the ultimate balance of properties desired as well as cost. Inorganic particles such as silicon carbide, silicon nitride and magnesium fluoride when in sol form are also useful for the present invention. The inorganic particles of the sol have an average particle size less than 100 nm, preferably less than 70 nm and most preferably less than 40 nm. A variety of colloidal sols useful in the present invention are commercially available from DuPont, Nalco Chemical Co., and Nyacol Products Inc.

The weight % of the inorganic particles of the aforesaid sol are preferred to be at least 5% and more preferred to be at least 10% of the dried antistatic layer of the invention to achieve the desired physical properties.

Other optional addenda that may be incorporated in the antistatic layer of the present invention include tooth-providing ingredients (vide U.S. Pat. No. 5,405,907, for example), colorants, crosslinking agents, surfactants and coating aids, defoamers, thickeners, coalescing aids, matte beads, lubricants, pH adjusting agents, plasticizers, and other ingredients known in the art.

The dry coverage of the antistatic layer of the present invention can be from 10 $mg/m^2$ to 10,000 $mg/m^2$, but preferably from 100 $mg/m^2$ to 1000 $mg/m^2$.

The coating solution for forming the antistatic layer of the present invention can be aqueous, non-aqueous or mixtures thereof, however, aqueous solutions are preferred for environmental reasons. The surface on which the coating solution is deposited for forming the antistatic layer can be treated for improved adhesion by any of the means known in the art, such as acid etching, flame treatment, corona discharge treatment, glow discharge treatment, etc, or can be coated with a suitable primer layer. However, corona discharge treatment is the preferred means for adhesion promotion.

The antistatic layer of the invention can be formed on any polymer sheet, with particular preference for those, which are known for their application as supports in imaging elements. The polymer sheet can comprise homopolymer(s), copolymer(s) or interpolymer(s) and/or mixtures thereof Typical imaging supports comprise cellulose nitrate, cellulose acetate, poly(vinyl acetate), polystyrene, polyolefins including polyolefin ionomers, polyesters including polyester ionomers, polycarbonate, polyamide, polyimide, glass, natural and synthetic paper, resin-coated or laminated paper, voided polymers including polymeric foam, microvoided polymers and microporous materials, or fabric, or any combinations thereof. Preferred polymers are polyesters, polyolefins and polystyrenes, mainly chosen for their desirable physical properties and cost.

Suitable polyolefins include polyethylene, polypropylene, polymethylpentene, polystyrene, polybutylene and mixtures thereof Polyolefin copolymers, including copolymers of propylene and ethylene such as hexene, butene and octene and mixtures thereof are also useful.

The polymer sheet can comprise a single layer or multiple layers according to need. The multiplicity of layers may include any number of auxiliary layers such as other antistatic layers and backmark retention layers, tie layers or adhesion promoting layers, abrasion resistant layers, curl control layers, cuttable layers, conveyance layers, barrier layers, other splice providing layers, UV absorption layers, antihalation layers, optical effect providing layers, waterproofing layers, flavor retaining layers, fragrance providing layers, adhesive layers, imaging layers and the like.

The polymer sheet can be formed by any method known in the art such as those involving extrusion, coextrusion, quenching, orientation, heat setting, lamination, coating and solvent casting. It is preferred that the polymer sheet is an oriented sheet formed by any suitable method known in the art, such as by a flat sheet process or a bubble or tubular process. The flat sheet process involves extruding or coextruding the materials of the sheet through a slit die and rapidly quenching the extruded or coextruded web upon a chilled casting drum so that the polymeric component(s) of the sheet are quenched below their solidification temperature.

The quenched sheet is then biaxially oriented by stretching in mutually perpendicular directions at a temperature above the glass transition temperature of the polymer(s). The sheet may be stretched in one direction and then in a second direction or may be simultaneously stretched in both directions. The preferred stretch ratio in any direction is at least 3:1. After the sheet has been stretched, it is heat set by heating to a temperature sufficient to crystallize the polymers while restraining to some degree the sheet against retraction in both directions of stretching.

The polymer sheet may be subjected to any number of coatings and treatments, after extrusion, coextrusion, orientation, etc. or between casting and full orientation, to improve its properties, such as printability, barrier properties, heat-sealability, spliceability, adhesion to other supports and/or imaging layers. Examples of such coatings can be acrylic coatings for printability, polyvinylidene halide for heat seal properties, etc. Examples of such treatments can be flame, plasma and corona discharge treatment, ultraviolet radiation treatment, ozone treatment and electron beam treatment to improve printability and adhesion. Further examples of treatments can be calendaring, embossing and patterning to obtain specific effects on the surface of the web. The polymer sheet can be further incorporated in any other suitable support by lamination, adhesion, cold or heat sealing, extrusion coating, or any other method known in the art. A preferred application of the invention is in imaging elements, including those utilizing photographic, electrophotographic, electrostatographic, photothermographic, migration, electrothermographic, dielectric recording, thermal dye transfer, inkjet and other types of imaging. A more preferred application of the invention is in photographic imaging elements, including photographic papers and films. Most preferred application of the invention is in photographic image display products, particularly those comprising a reflective support, which in turn comprises any material such as, natural paper, synthetic paper, unvoided polymers, voided polymers including polymeric foam, microvoided polymers and microporous materials, fabric, or combinations thereof The photographic elements can be single color elements or multicolor elements. Multicolor elements contain image dye-forming units sensitive to each of the three primary regions of the spectrum. Each unit can comprise a single coupler and emulsion layer or multiple coupler and emulsion layers each sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The antistatic layer of the invention can be placed on any side of the polymer sheet of the imaging element, e.g., on the top side, or the bottom side, or both sides. However, it is preferred to be placed on the bottom side of the polymer sheet. The aforementioned top side refers to the image receiving side whereas the bottom side refers to the opposite side of the polymer sheet. The antistatic layer can be placed anywhere in the imaging element either as an external layer or as an internal layer. However, it is preferred to be placed as an external backing layer. In addition to the antistatic layer, the imaging element can comprise other layers, such as but not limited to, protective layer, adhesion promoting layer, interlayer and the like.

In a preferred embodiment of the invention the antistatic layer is incorporated in a photographic support comprising paper, coated with and/or laminated with polyolefin. Such a support can be prepared by extrusion coating and/or laminating one or more layers of polyolefin resin on substrate paper. The surface of the substrate paper can be treated for improved adhesion prior to resin coating by any of the known methods of the art, e.g., acid etching, flame treatment, corona discharge treatment, glow discharge treatment, etc. The side of the polyolefin resin coated paper on which photographic emulsion layers are provided may have a gloss surface, matte surface, silk-like surface, etc. and the backside usually has but not limited to a dull surface.

Suitable polyolefins for the present invention include polyethylene, polypropylene, polymethylpentene, polystyrene, polybutylene and mixtures thereof. Polyolefin interpolymers, including interpolymers of propylene and ethylene such as hexene, butene and octene are also useful. The present invention is particularly suitable for photographic paper comprising biaxially oriented microvoided polypropylene layer(s), as disclosed in U.S. Pat. Nos. 5,853,965, 5,866,282 and 5,874,205 incorporated in their entirety herein by reference.

Suitable paper may comprise normal natural pulp paper and/or synthetic paper, which is simulated paper made from synthetic resin films. However, natural pulp paper mainly composed of wood pulp such as soft wood pulp, hard wood pulp, and mixed pulp of soft wood and hard wood, is preferred. The natural pulp may contain, in optional combination, various high molecular compounds and additives, such as, dry strength increasing agents, sizing agents, wet strength increasing agents, stabilizers, pigments, dyes, fluorescent whiteners, latexes, inorganic electrolytes, pH regulators, etc.

The polyolefin layer(s) may preferably contain, in suitable combination, various additives, for instance white pigments such as titanium oxide, zinc oxide, talc, calcium carbonate, barium sulfate, etc., dispersants for example fatty amides such as stearamide, etc., metallic salts of fatty acids such as zinc stearate, magnesium stearate, etc., pigments and dyes, such as ultramarine blue, cobalt violet, etc., antioxidant, fluorescent whiteners, ultraviolet absorbers.

The coating compositions of the invention may be applied by any well known coatings method such as air knife coating, gravure coating, hopper coating, roller coating, spray coating, and the like.

While different photographic elements may require different coverages, the present invention may be applied to both color and black and white photographic papers with adjusted coverage values depending on the particular application.

The present invention is further illustrated by the following examples of its practice.

WORKING EXAMPLES & COMPARATIVE SAMPLES

Materials

The materials used in the antistatic layers of the examples and comparative samples described herein below include:

Chlorinated Polyolefin (CPO)

Waterborne chlorinated polyolefin dispersions, eg. Eastman CP310W, CP347W and CP349W supplied by Eastman Chemicals.

Other Polymeric Binder

Styrene acrylate latex, eg. Neocryl™ A5045, supplied by Avecia. Same as Polymer A of U.S. Pat. No. 6,171,769

Conductive Agents

Ionic Conductive Agents:

Combination of polyethylene ether glycol Carbowax 3350 supplied by Union Carbide and lithium nitrate in a dry weight ratio of 40:60.

Electronic Conductive Agents:

Acicular antimony doped tin oxide dispersion, eg. FS 10D supplied by Ishihara Techno Corp.

Zinc antimonate colloidal dispersion, eg. Celnax™ CX-Z300H supplied by Nissan Chemical Industries

Inorganic Oxide Sol

Alumina modified colloidal silica, eg. Ludox™ AM supplied by DuPont

Sample Preparation

Layers are coated from aqueous solutions of various compositions on to a photographic paper support comprising a paper core laminated on both sides with biaxially oriented polyolefin based sheets. This photographic paper support is similar to Sample C (invention) of U.S. Pat. No. 6,232,056 but without the Fusible layer (L7) and Writable/conductive layer (L8). The surface on which the aforesaid aqueous solutions of various compositions is coated is a biaxially oriented polypropylene based terpolymer, similar to the matte surface of BICOR 70 MLT supplied by ExxonMobil Corporation (vide, for example, U.S. Pat. No.5,853,965 for specifics). The terpolymer surface is corona discharge treated, followed by hopper coating of the coating solutions, and subsequent drying by hot air at or below 180° F.

Test Methods

For resistivity tests, samples are preconditioned at 72° F. under specific relative humidity (RH) for at least 24 hours prior to testing. Surface electrical resistivity (SER) of the coated antistatic layer is measured with a Keithly Model 616 digital electrometer using a two point DC probe by a method similar to that described in U.S. Pat. No. 2,801,191.

For backmark retention tests on photographic paper, a printed image is applied onto the coated antistatic layer using a dot matrix printer. The paper is then subjected to a conventional developer for 30 seconds, washed with warm water for 5 seconds and rubbed for print retention evaluation. The following ratings are assigned for backmark retention (BMR), with a rating of 1–3 being indicative of acceptable performance:

1=Outstanding, very little difference between processed and unprocessed appearance.

2=Excellent, slight degradation of appearance

3=Acceptable, medium degradation of appearance

4=Unacceptable, serious degradation of appearance

5=Unacceptable, total degradation.

For spliceability, a splice is made between two strips of photographic paper, with the antistatic layer on one strip being in contact with the photographic emulsion on the other strip, as described in U.S. Pat. No. 6,171,769. Splicing is carried out using a splicing module used in commercial photofinishing equipment such as the Gretag CLAS 35 printer. The peel strength of the resultant splice is determined in an Instron machine, as a measure of spliceability.

Dust generation is assessed by means of a frictional wear test. A 1474 gram weight having three round rubber feet 0.25 inches in diameter (66 psi per foot) is placed on a black sheet of paper. The paper and weight are placed on top of the antistat coating and dragged over a distance of 10 inches back and forth 5 times (total dragged distance of 50 inches). The dust generation is subjectively rated from visual inspection of the amount of material transferred to the black paper. The rating scale is as follows:

1=no transfer

2=barely visible transfer

3=easily visible transfer, no distinct deposits

4=easily visible transfer, distinct deposits

5=large, elongated deposits of transfer

Samples Ex. 1–3 were prepared in accordance with the present invention using different CPO. As a comparison, sample Comp.A was prepared similarly but without any CPO and using the binder polymer disclosed in U.S. Pat. No. 6,171,769. The details about these samples and the corresponding test results are listed in Tables 1A and 1B, respectively.

TABLE 1A

| Sample | $LiNO_3$ Dry wt. % | Carbowax Dry wt. % | Ludox Dry wt. % | CPO Dry wt. % | Neocryl A5045 Dry wt. % | Coverage g/m$^2$ |
|---|---|---|---|---|---|---|
| Ex. 1 | 4.6 | 3.1 | 18.5 | 73.8 (CP310W) | | 0.3 |

TABLE 1A-continued

| Sample | $LiNO_3$ Dry wt. % | Carbowax Dry wt. % | Ludox Dry wt. % | CPO Dry wt. % | Neocryl A5045 Dry wt. % | Coverage g/m$^2$ |
|---|---|---|---|---|---|---|
| Ex. 2 | 4.6 | 3.1 | 18.5 | 73.8 (CP347W) | | 0.3 |
| Ex. 3 | 4.6 | 3.1 | 18.5 | 73.8 (CP349W) | | 0.3 |
| Comp. A | 4.6 | 3.1 | 18.5 | | 73.8 | 0.3 |

TABLE 1B

| | SER, log Ω/□ | | | Splice | | |
|---|---|---|---|---|---|---|
| Sample | 20% RH | 50% RH | 80% RH | strength g | BMR | Dusting |
| Ex. 1 | 10.5 | 9.3 | 8.1 | 976 | 1-2 | 1 |
| Ex. 2 | 10.2 | 9.2 | 8.2 | 742 | 1-2 | 1 |
| Ex. 3 | 10.1 | 9.1 | 8.1 | 1118 | 1-2 | 1 |
| Comp. A | 13.2 | 10.7 | 9.1 | 226 | 1-2 | 3 |

It is very clear that samples Ex. 1–3, prepared with a variety of CPO as per the present invention show superior SER values, i.e., at least an order of magnitude lower resistivity, over a wide range of humidity in comparison to sample Comp. A, containing no CPO. Additionally, the splice strengths of Ex. 1–3 are also substantially higher than that of Comp. A. Moreover, dusting performance of samples Ex. 1–3 is also superior to that of Comp. A.

Samples Ex.4–6 were prepared similar to Samples Ex.1–3, respectively, except without any $LiNO_3$. As a comparison, sample Comp.B was prepared similar to sample Comp. A, except without any $LiNO_3$. The details about these samples and the corresponding test results are listed in Tables 2A and 2B, respectively.

TABLE 2A

| Sample | $LiNO_3$ Dry wt. % | Carbowax Dry wt. % | Ludox Dry wt. % | CPO Dry wt. % | Neocryl A5045 Dry wt. % | Coverage g/m$^2$ |
|---|---|---|---|---|---|---|
| Ex. 4 | | 3.2 | 19.4 | 77.4 (CP310W) | | 0.3 |
| Ex. 5 | | 3.2 | 19.4 | 77.4 (CP347W) | | 0.3 |
| Ex. 6 | | 3.2 | 19.4 | 77.4 (CP349W) | | 0.3 |
| Comp. B | | 3.2 | 19.4 | | 77.4 | 0.3 |

TABLE 2B

| | SER, log Ω/□ | | | Splice | | |
|---|---|---|---|---|---|---|
| Sample | 20% RH | 50% RH | 80% RH | strength g | BMR | Dusting |
| Ex. 4 | 12.8 | 12.4 | 11.4 | 892 | 1-2 | 2 |
| Ex. 5 | 12.8 | 12.3 | 11.4 | 1143 | 1-2 | 1 |
| Ex. 6 | 13 | 12.4 | 11.5 | 1122 | 1-2 | 2 |
| Comp. B | 14.6 | 14.4 | 13.7 | 243 | 1-2 | 2 |

It is very clear that samples Ex.4–6 show superior SER values, i.e., more than an order of magnitude lower resistivity, over a wide range of humidity in comparison to sample Comp. B. Additionally, the splice strengths of Ex. 4–6 are also substantially higher than that of Comp. B. These results demonstrate that CPO without any additional conductive agent can provide an adequate antistatic layer, together with other desired properties (e.g., splice strength, BMR, dusting), for application in photographic paper whereas the polymeric binder of U.S. Pat. No. 6,171,769 lacks the necessary conductivity. Although Ex 4–6 perform reasonably well and better than the prior art (Comp. B), for superior performance the composition of the invention including additional conductive agent is preferred.

Samples Ex.7–9 were prepared similar to sample Comp.A, except that the polymeric binder Neocryl A5045 was blended with a CPO, namely CP349W, in 5/95, 10/90 and 20/80 weight ratio, respectively. The details about these samples and the corresponding test results are listed in Tables 3A and 3B, respectively. For ease of comparison, the test results of sample Comp.A are also included in Table 3B.

TABLE 3A

| Sample | $LiNO_3$ Dry wt. % | Carbowax Dry wt. % | Ludox Dry wt. % | CPO (CP349W) Dry wt. % | Neocryl A5045 Dry wt. % | CPO/ Neocryl Wt. ratio | Coverage $g/m^2$ |
|---|---|---|---|---|---|---|---|
| Ex. 7 | 4.6 | 3.1 | 18.5 | 3.7 | 70.1 | 5/95 | 0.3 |
| Ex. 8 | 4.6 | 3.1 | 18.5 | 7.4 | 66.4 | 10/90 | 0.3 |
| Ex. 9 | 4.6 | 3.1 | 18.5 | 14.8 | 59.0 | 20/80 | 0.3 |

TABLE 3B

| Sample | SER, log Ω/□ 60% RH | Splice strength g |
|---|---|---|
| Comp. A | 9.3 | 226 |
| Ex. 7 | 9.0 | 801 |
| Ex. 8 | 8.8 | 1409 |
| Ex. 9 | 8.1 | 1980 |

It is very clear that the blending of even a small amount of CPO can greatly improve the splice strength and SER of an antistatic layer, such as one taught in U.S. Pat. No. 6,171,769. This demonstrates the superiority of the present invention over some of the prior art.

Samples Ex. 10–13 were prepared in accordance with the present invention, using various CPO and electronically conductive particles such as zinc antimonite or acicular tin oxide. The details about these samples and the corresponding test results are listed in Tables 4A and 4B, respectively.

TABLE 4A

| Sample RC5-8276 | Sample | Electronic conductor Dry wt. % Zinc antimonite Celnax CX-Z300H | Acicular tinoxide FS-10D | CPO Dry wt. % | Coverage $g/m^2$ |
|---|---|---|---|---|---|
| 18 | Ex. 10 | 75 | | 25 (CP310W) | 0.3 |
| 19 | Ex. 11 | 75 | | 25 (CP347W) | 0.3 |
| 20 | Ex. 12 | 75 | | 25 (CP349W) | 0.3 |
| 10 | Ex. 13 | | 25 | 75 (CP310W) | 0.3 |

TABLE 4B

| Sample | SER, log Ω/□ 20% RH | 50% RH | 80% RH | Splice strength g | BMR | Dusting |
|---|---|---|---|---|---|---|
| Ex. 10 | 8.7 | 8.7 | 8.8 | 1268 | 1–2 | 2 |
| Ex. 11 | 9.2 | 9.2 | 9.3 | 1124 | 1–2 | 2 |
| Ex. 12 | 9.2 | 9.2 | 9.4 | 1179 | 1–2 | 2 |
| Ex. 13 | 9.9 | 9.9 | 9.9 | 1208 | 1–2 | 1 |

It is clear that electronically conductive particles can be formulated with a variety of CPO and incorporated as antistatic layers on photographic paper, with highly desirable properties.

The invention has been described in detail with particular reference to certain preferred embodiments thereof, but it will be understood that variations and modifications can be effected within the spirit and the scope of the invention.

What is claimed is:

1. A composition for an antistat layer comprising:

a chlorinated polyolefin;

a conductive agent that comprises an electrically conductive polymer; and a solvent consisting essentially of water.

2. The composition of claim 1 further comprising a colloidal sol.

3. The composition of claim 2 wherein the colloidal sol comprises metal oxides selected from the group consisting of tin oxide, titania, antimony oxide, zirconia, ceria, yttria, zirconium silicate, silica, alumina, aluminum modified silica, and mixtures thereof.

4. The composition of claim 2 wherein the metal oxides of the colloidal sol comprises at least 5 weight % of the solid content of the composition.

5. The composition of claim 1 further comprising a binder that is different from the chlorinated polyolefin.

6. The composition of claim 5 wherein the binder is selected from the group consisting of a water soluble polymer, a hydrophilic colloid, a water insoluble polymer, a water insoluble latex, a water insoluble dispersion, and mixtures thereof.

7. The composition of claim 5 wherein the binder is selected from the group consisting of polymers and interpolymers prepared from ethylenically unsaturated monomers.

8. The composition of claim 7 wherein the ethylenically unsaturated monomer is selected from the group consisting of styrene, styrene derivatives, acrylic acid or methacrylic acid and their derivatives, olefins, (meth)acrylonitriles, itaconic acid and its derivatives, maleic acid and its derivatives, vinyl halides and vinylidene halides.

9. The composition of claim 5 wherein the binder is selected from the group consisting of aqueous dispersions of polyurethanes and polyesters and primary amine addition salt interpolymers.

10. The composition of claim 9 wherein the primary amine addition salt interpolymer is an interpolymer that contains a polymerized vinyl monomer having a primary amine addition salt component.

11. The composition of claim 1 wherein the conductive agent is an electronically conductive polymer selected from the group consisting of substituted or unsubstituted aniline-containing polymers, substituted or unsubstituted thiophene-containing polymers, substituted or unsubstituted pyrrole-containing polymers and derivatives thereof.

12. The composition of claim 11 wherein the electronically conductive polymer is selected from the group consisting of poly(3,4-ethylene dioxypyrrole styrene sulfonate), poly(3,4-ethylene dioxythiophene styrene sulfonate) and polypyrrole styrene sulfonate.

13. The composition of claim 1 wherein the chlorinated polyolefin comprises 15–35 weight % of chlorine.

14. The composition of claim 1 wherein the chlorinated polyolefin has a molecular weight between 9000 and 150,000.

15. The composition of claim 1 wherein the chlorinated polyolefin is a modified chlorinated polyolefin.

16. The composition of claim 1 wherein the modified chlorinated polyolefin is modified by grafting of an imide or by grafting of a monomer.

17. The composition of claim 16 wherein the monomer comprises carboxylic acid group or carboxylic anhydride group.

18. The composition of claim 1 wherein the chlorinated polyolefin comprises a homopolymer or interpolymer of propylene.

19. The composition of claim 1 wherein the chlorinated polyolefin comprises at least 3 weight % of the solid content of the composition.

20. The composition of claim 1 wherein the conductive agent comprises metal particles that comprise 20–80 volume % of the solid content of the composition.

21. The composition of claim 1 wherein the conductive agent comprises acicular tin oxide particles that comprise 5–50 volume % of the solid content of the composition.

22. The composition of claim 1 wherein the conductive agent is an electronically conductive polymer that comprises 2–30 weight % of the solid content of the composition.

* * * * *